US007150574B1

(12) United States Patent
Cerqua

(10) Patent No.: US 7,150,574 B1
(45) Date of Patent: Dec. 19, 2006

(54) DEVICE FOR APPLYING A FOOD SPREAD

(76) Inventor: Patrick A. Cerqua, 1865 Willow Way, Vista, CA (US) 92081

( * ) Notice: Subject to any disclaimer, the term of this patent is extended or adjusted under 35 U.S.C. 154(b) by 0 days.

(21) Appl. No.: 11/374,993

(22) Filed: Mar. 15, 2006

(51) Int. Cl.
*A46B 11/00* (2006.01)

(52) U.S. Cl. ..... 401/12; 401/9; 401/11

(58) Field of Classification Search ..... 401/9–12; 118/113; 30/124, 130; D7/666
See application file for complete search history.

(56) References Cited

U.S. PATENT DOCUMENTS

| | | | | |
|---|---|---|---|---|
| 1,097,465 | A | | 5/1914 | Pratt |
| 1,305,806 | A | * | 6/1919 | Keppeler ..... D7/666 |
| 1,494,018 | A | | 5/1924 | Randolph |
| D157,183 | S | | 2/1950 | Newell |
| D159,748 | S | | 8/1950 | Mossel |
| 2,527,149 | A | | 10/1950 | Peterson |
| 2,565,874 | A | | 8/1951 | Mossel |
| 2,690,657 | A | | 10/1954 | Milewski |
| 2,691,877 | A | | 10/1954 | Frolich |
| 2,740,195 | A | * | 4/1956 | Stadeli et al. ..... 30/124 |
| 2,756,498 | A | | 7/1956 | Wasser |
| D178,487 | S | | 8/1956 | Becker |
| 2,811,844 | A | | 11/1957 | Selmer |
| 2,814,868 | A | | 12/1957 | Wellinger |
| 2,887,948 | A | * | 5/1959 | Irving et al. ..... 100/213 |
| 3,005,225 | A | | 10/1961 | Faust |
| 3,031,712 | A | | 5/1962 | Wilson |
| 3,449,829 | A | | 6/1969 | Mattinson |
| 3,735,487 | A | | 5/1973 | Wojcik |
| 4,408,919 | A | | 10/1983 | Wolff et al. |
| D272,796 | S | | 2/1984 | Wolff |
| 4,715,639 | A | | 12/1987 | Nicoletta et al. |
| D296,646 | S | | 7/1988 | Yoder |
| 4,923,234 | A | | 5/1990 | Fairley |
| 5,858,089 | A | | 1/1999 | Martinovic |
| D433,289 | S | * | 11/2000 | Durbin et al. ..... D7/666 |
| D478,483 | S | | 8/2003 | Kotsonis |

FOREIGN PATENT DOCUMENTS

| | | | |
|---|---|---|---|
| FR | 2740958 | | 5/1997 |
| GB | 2107973 | A * | 5/1983 |
| GB | 2219921 | | 12/1989 |
| JP | 9215578 | | 8/1997 |

* cited by examiner

*Primary Examiner*—Khoa D. Huynh
(74) *Attorney, Agent, or Firm*—Richard C. Litman

(57) ABSTRACT

The device for applying a food spread is a utensil for applying a food spread, such as butter, to food, such as an ear of corn. The device includes an upper arm and a lower arm, each having a first end and a second end. The arms are pivotally joined at their first ends. An upper plate is mounted to the second end of the upper arm, and a lower plate is mounted to the second end of the lower arm. The upper plate has a solid and continuous surface, while the lower plate has a plurality of slots formed therethrough. In use, a pat of butter is placed between the upper and lower plates and the user applies pressure to the arms to squeeze the butter through the slots in a controlled manner.

6 Claims, 5 Drawing Sheets

DEVICE FOR APPLYING A FOOD SPREAD

BACKGROUND OF THE INVENTION

1. Field of the Invention

The present invention relates to eating utensils, and particularly to a device for applying a food spread, and more specifically to a tong-like device for spreading butter on corn on the cob or other cylindrical food items.

2. Description of the Related Art

Food spreads, such as butter and margarine, are often used on hot food, such as cooked ears of corn. Conventionally, butter is spread on the corn with a butter knife or similar utensil. Since the knife offers only a planar surface, the butter remains positioned on the knife through adhesion only, with no further engagement. Thus, the butter easily slides off the knife when melted and can drip onto a table or the user's clothing, thereby causing damage through staining. Further, because the butter is not held stably in place on the knife, the butter distribution on the ear of corn is non-homogeneous in terms of volume and surface area coverage, resulting in much of the melted butter being wasted.

Thus, a device for applying a food spread solving the aforementioned problems is desired.

SUMMARY OF THE INVENTION

The device for applying a food spread is a handheld utensil for user-controlled application of a food spread, such as butter, to a piece of food, such as an ear of corn. The device includes an upper arm and a lower arm, each having a first end and a second end. The arms are joined at their first ends, and may be made in separate pieces pivotally attached to each other, or made in a single piece joined by a resilient portion in order to pivot at the juncture of the two arms. An upper plate is mounted to the second end of the upper arm, and a lower plate is mounted to the second end of the lower arm. Preferably, the upper plate and lower plate each have a substantially arcuate cross-sectional contour.

The upper plate has a solid and continuous surface, while the lower plate has a plurality of slots formed therethrough. In use, a pat of butter is placed between the upper and lower plates and the user applies pressure to the arms to squeeze the butter through the slots in a controlled manner. The upper and lower plates are preferably convexly contoured so that a cylindrical food object, such as an ear of corn, may be received within the curve of the lower plate in order to make direct contact with the butter and, further, to allow the butter to be evenly distributed over the food object's surface.

Further, the upper plate is preferably contoured so that it may be used in a manner similar to that of a spoon, allowing the user to scoop or spoon the pat of butter directly from a stick of butter. The upper and lower plates may be contoured so that they have substantially equal radii of curvature, and each arm may be tapered for user comfort and for decorative purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
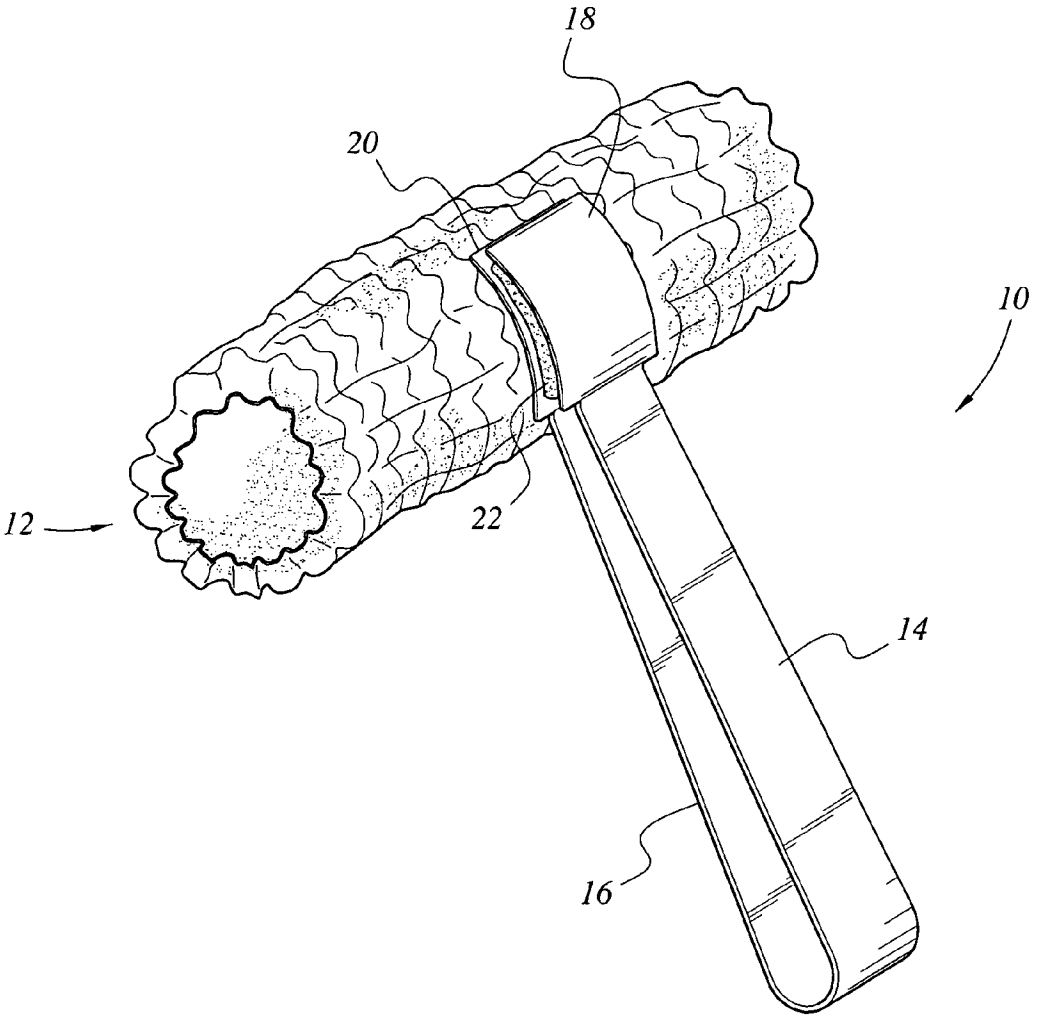
FIG. 1 is an environmental, perspective view of a device for applying a food spread according to the present invention.

FIG. 1 shows a device 10 for applying a food spread 22 to a piece of food 12. Particularly, FIG. 1 illustrates the device 10 being used to apply butter 22 an ear of corn 12. However, it should be understood that any suitable food spread, such as margarine, may be applied to any suitable food 12, such as a bread roll or other cylindrical food item, using device 10.

As shown, a volume of butter 22 is held between an upper plate 18 and a lower plate 20, which are, respectively, mounted on an upper arm 14 and a lower arm 16. The user grasps upper arm 14 and lower arm 16 in order to stably hold butter 22 in place, and the user squeezes upper arm 14 and lower arm 16 together in order to squeeze butter 22 between plates 18, 20 and apply the butter 22 to the ear of corn 12 in a manner that will be described in further detail below.

Figure 2:
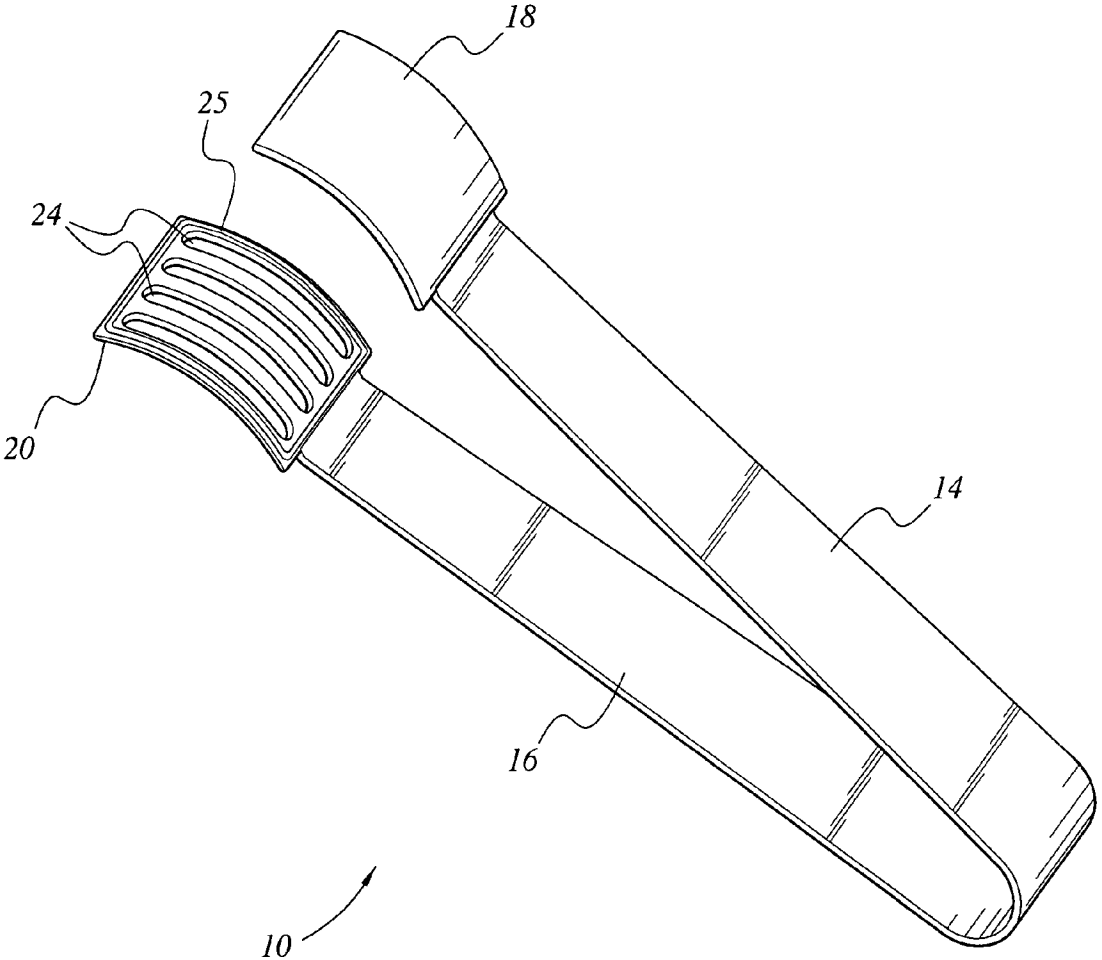
FIG. 2 is a perspective view of a device for applying a food spread according to the present invention.

As illustrated in FIG. 2, each of arms 14, 16 has a first end and a second end, and each is elongated in a longitudinal direction. Arms 14, 16 are joined, each to the other, at their respective first ends. Preferably, device 10 is manufactured in one piece. The device may be initially formed as a flat piece and bent along a central portion thereof to form upper arm 14 and lower arm 16, as shown in FIG. 2. In this preferred embodiment, no separate hinge or other pivotal mounting is required. The two arms are joined by a resilient portion, so that the arms 14 and 16 may be compressed to hold the spread 22, but spring back to the open, separated position shown in FIG. 2 when the compressive force is released. The joint between the two arms may be made from spring steel, from resilient plastic, or other suitable material for making tongs conventionally known in the art.

Alternatively, arms 14 and 16 may be made as separate pieces joined by a torsion spring, or by a hinge biased by a torsion or leaf spring, or pivotally joined in any other manner.

Upper plate 18 is mounted to the second end of upper arm 14 and projects forwardly therefrom. Upper plate 18 forms a smooth, solid and continuous surface. Lower plate 20 is mounted to the second end of lower arm 16 and projects forwardly therefrom. Lower plate 20 preferably has substantially identical dimensions and arcuate contouring to that of upper plate 18. A plurality of slots 24 are formed through lower plate 20. Although shown as extending in the longitudinal direction, it should be understood that any number, size and orientation of slots 24 may be formed in lower plate 20.

The dimensioning of device 10 is not critical. Representative dimensions are as follows. Upper arm 14 and lower arm 16 are each approximately four inches in length and approximately 1⅛ inches in width. The arms 14 and 16 may have a substantially rectangular contour, or may be tapered. If tapered, the maximum width may be approximately 1⅛ inches and the minimum width may be approximately ¾ of an inch width, the length of each arm being approximately four inches.

Figure 3:
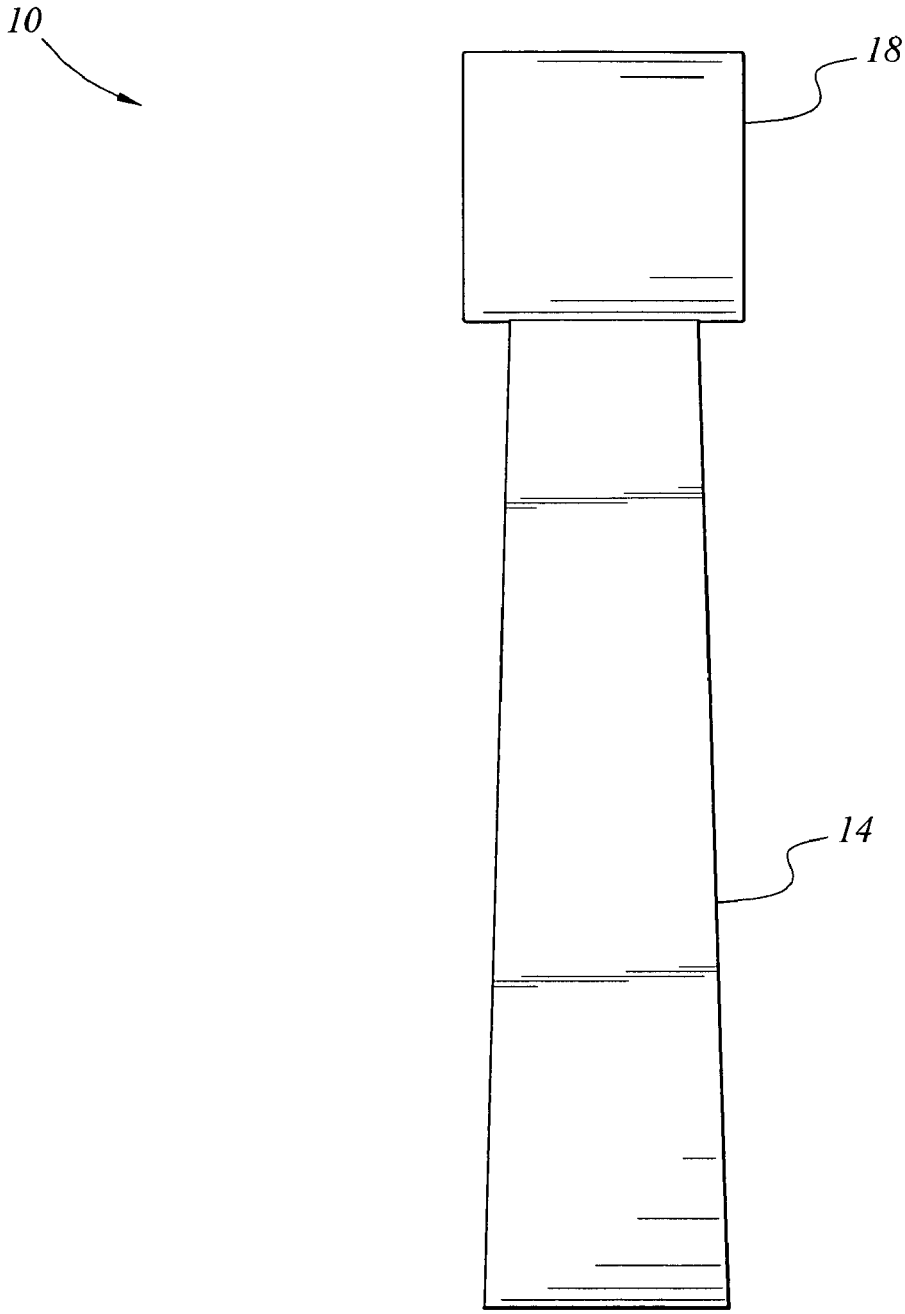
FIG. 3 is a top view of a device for applying a food spread according to the present invention.

When viewed from above, as in FIG. 3, each of the upper plate 18 and lower plate 20 has a substantially rectangular contour. Preferably, the corners of each plate 18, 20 are rounded or smoothed for comfortable and safe use by the user. Plates 18 and 20 may be approximately 1⅛ inches in width and approximately 1¼ inches in length. Each slot 24 formed through lower plate 20 may be, e.g., approximately one inch in length and approximately 5/32 of an inch in width, with four evenly spaced slots 24 being formed through plate 20.

Figure 4:
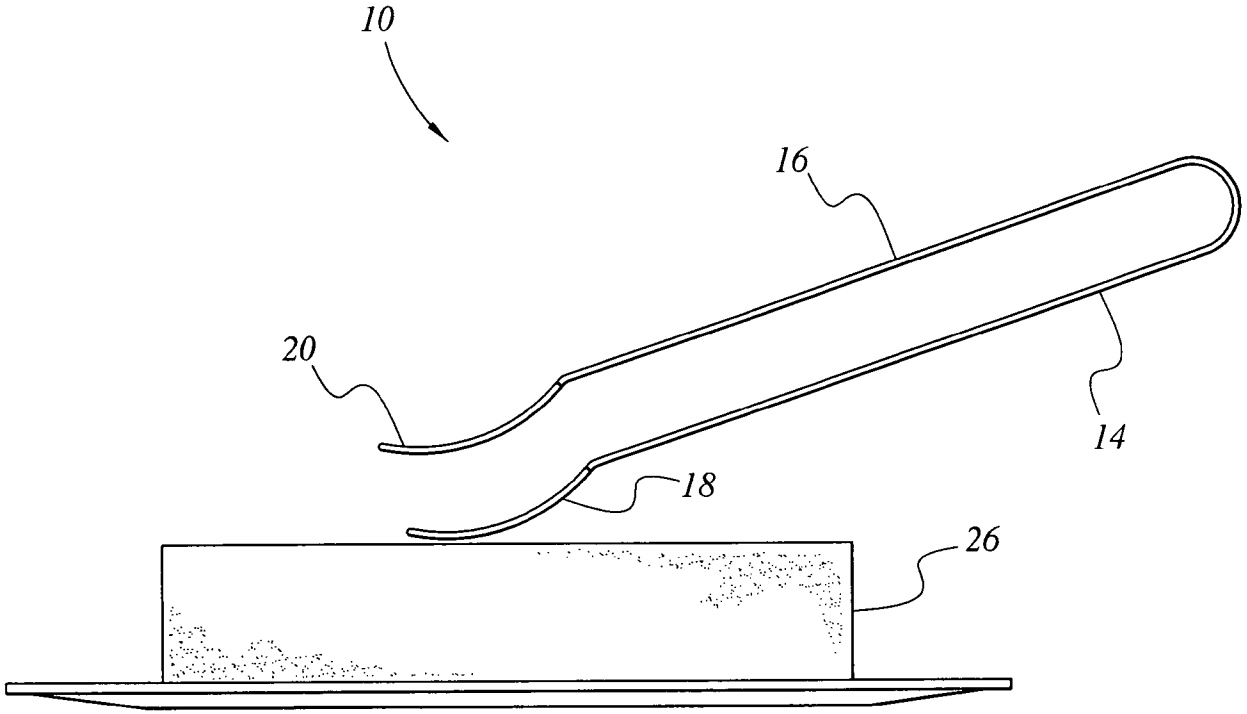
FIG. 4 is an environmental side view of the device for applying a food spread according to the present invention being used in a first position.
Figure 5:
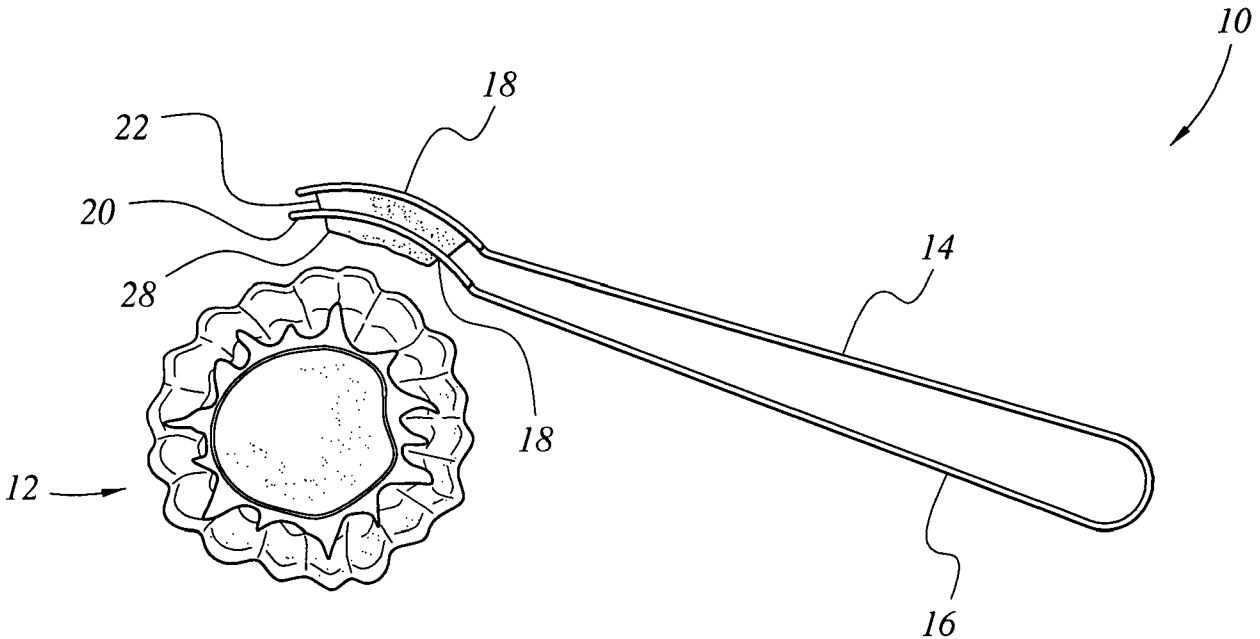
FIG. 5 is an environmental side view of the device for applying a food spread according to the present invention being used in a second position.

As shown in FIGS. 4 and 5, each of upper plate 18 and lower plate 20 has a substantially arcuate cross-sectional contour. For example, each plate 18, 20 may have a side cross-sectional contour approximating a segment of a circle having a radius of curvature of approximately 1 5/16 inches. The vertical distances between the side edges of each plate 18, 20 and the maximal point on the arc may be approximately ¼ of an inch. Plates 18 and 20 may be positioned and contoured so that upper plate 18 can fit flush against lower plate 20 when the user squeezes arms 14, 16 together and when no butter 22 is received between the plates.

The device 10 may be constructed of any suitable materials that are easily cleaned, noncorrosive and resilient. For example, the device 10 may be constructed from approximately 0.024 inch thick 304 stainless steel. The surface of device 10 may have a brushed finish and may include indicia or other ornamentation for decorative purposes.

As illustrated in FIG. 4, in order to place butter 22 between plates 18, 20, the user may use upper plate 18 as a spoon or a knife, scooping butter from a butter supply 26. Although shown as a stick of butter, it should be understood that the butter supply 26 may be any suitable source of food spread, such as a tub or other container containing the food spread. Alternatively, the user may insert a pre-formed pat of butter between plates 18 and 20.

As shown in FIG. 5, once butter 22 has been inserted between upper plate 18 and lower plate 20, the user squeezes handles 14 and 16 together, decreasing the distance of separation between upper plate 18 and lower plate 20, thusly squeezing a portion of butter 28 through slots 24. The squeezed portion of butter 28 may be applied to a suitable piece of food. In the example illustrated in FIGS. 1 and 5, the butter 28 is being applied to an ear of corn 12.

Upper plate 18 and, particularly, lower plate 20 are convexly curved so that ear of corn 12 may be received within the arcuate recess formed by lower plate 20. Due to the curvature of the lower plate 20, the ear of corn 12 may be freely rotated with respect to device 10, with butter 28 being evenly distributed over the surface of ear of corn 12. Further, due to the curvature and mating between the ear of corn 12 and the lower plate 20, stray drops of the butter are minimized, thus saving time and energy of the user in terms of the clean-up process associated with buttering an ear of corn. Alternatively, lower plate 20 may further have a raised lip 25, seen most clearly in FIG. 2, formed around a perimeter thereof in order to prevent butter 22 from squeezing beyond the perimeter. The raised lip 25 maintains the pat of butter 22 in a relatively and substantially stable position, preventing the butter 22 from oozing in the lateral and longitudinal directions when plates 18, 20 are squeezed together.

Due to the one-piece construction, and the resilient nature of the materials used in construction, upper arm 14 and lower arm 16 provide elastic resistance to the squeezing force applied by the user. This allows the user to control, via the user's grip and force applied, the positioning of upper plate 18 with respect to lower plate 20, which controls the quantity of butter 28 that oozes through slots 24. This allows the user to control the amount of butter being applied to the ear of corn 12.

It is to be understood that the present invention is not limited to the embodiments described above, but encompasses any and all embodiments within the scope of the following claims.

I claim:

1. A device for applying a food spread, comprising:

an upper elongated arm and a lower elongated arm, each said arm having a first end and a second end, wherein each said arm is resiliently joined together at the first end to form a substantially U-shaped bent section;

wherein said upper elongated arm is tapered along a longitudinal direction from said first end toward said second end, and wherein said lower elongated arm is tapered along a longitudinal direction from said first end toward said second end;

an upper plate extending from the second end of the upper arm, the upper plate having a substantially convex arcuate cross-sectional contour; and a lower plate extending from the second end of the lower arm, the lower plate having a substantially convex arcuate cross-sectional contour and having a plurality of slots formed therethrough;

wherein the upper arm, the lower arm, the bent section, the upper plate and the lower plate are formed in one piece;

whereby a user compresses a food spread between the upper and lower plates through application of pressure to the upper and lower arms, thereby forcing the food spread through the plurality of slots for application to an item of food, and upon release of pressure the upper and lower arms resiliently return to a spaced-apart position.

2. The device for applying a food spread according to claim 1, wherein said lower plate has a radius of curvature dimensioned and configured for conforming to an ear of corn, whereby the food spread is evenly applied to the ear of corn.

3. The device for applying a food spread according to claim 1, wherein said upper plate and said lower plate have substantially equal radii of curvature.

4. The device for applying a food spread according to claim 1, wherein each of said plurality of slots is elongated and extends in a substantially longitudinal direction.

5. The device for applying a food spread according to claim 1, further comprising a raised lip formed along a periphery of an upper surface of said lower plate for maintaining the food spread in a substantially stable position with respect to said lower plate.

6. The device for applying a food spread according to claim 1, wherein the device is made from stainless steel.

* * * * *